US007013789B2

(12) United States Patent
Dillon

(10) Patent No.: US 7,013,789 B2
(45) Date of Patent: Mar. 21, 2006

(54) INTEGRAL LATCHING SYSTEM FOR MACHINE GUN TOP COVER AND SAFING SECTOR ASSEMBLY

(76) Inventor: Michael J. Dillon, 8009 E. Dillon's Way, Scottsdale, AZ (US) 85260-1809

( * ) Notice: Subject to any disclaimer, the term of this patent is extended or adjusted under 35 U.S.C. 154(b) by 266 days.

(21) Appl. No.: 10/714,172

(22) Filed: Nov. 14, 2003

(65) Prior Publication Data

US 2005/0115393 A1 Jun. 2, 2005

(51) Int. Cl.
*F41A 1/00* (2006.01)

(52) U.S. Cl. ..... 89/12

(58) Field of Classification Search ..... 89/12, 89/9, 11, 1.41

See application file for complete search history.

(56) References Cited

U.S. PATENT DOCUMENTS

| | | | | |
|---|---|---|---|---|
| 3,380,341 | A * | 4/1968 | Chiabrandy | 89/12 |
| 3,380,342 | A * | 4/1968 | Chiabrandy | 89/12 |
| 3,380,343 | A * | 4/1968 | Chiabrandy et al. | 89/12 |
| 3,766,821 | A * | 10/1973 | Cozzy et al. | 89/12 |
| 6,443,044 | B1 * | 9/2002 | Dillon | 89/12 |

* cited by examiner

*Primary Examiner*—M. Clement
(74) *Attorney, Agent, or Firm*—William E. Hein

(57) ABSTRACT

A top cover and safing sector assembly of a 7.62 mm Gatling machine gun, commonly known as a minigun, incorporates integral latch assemblies that cooperate with top cover and safing sector latch keepers conventionally provided on such machine guns to facilitate opening of the top cover independent of the safing sector or, alternatively, opening of the entire top cover and safing sector assembly, both of which are accomplished without the use of prior art ball locking pins and the need for removal and attendant risk of loss thereof.

3 Claims, 3 Drawing Sheets

INTEGRAL LATCHING SYSTEM FOR MACHINE GUN TOP COVER AND SAFING SECTOR ASSEMBLY

BACKGROUND AND SUMMARY OF THE INVENTION

This invention relates generally to automatic weapons of the Gatling machine gun type and, more specifically, to the class of such guns known as 7.62 miniguns and improvements therein that serve to make them easier to use by incorporating a convenient integral latching mechanism in the top cover and safing sector assembly of such guns.

The 7.62 minigun is a six-barreled, electric-driven machine gun originally designed and built by General Electric Company in the mid 1960's for the U.S. military. This gun has been in use since its inception by both U.S. and foreign military forces. Compared to other small caliber machine guns, the 7.62 minigun is complicated and, under operational conditions, often unreliable.

The 7.62 minigun, hereinafter referred to as either a minigun or machine gun, utilizes a main housing enclosing and supporting a main rotary body known as a rotor assembly. Cartridges, each of which is a single round of ammunition, are handled within the main housing by what are called bolt assemblies. The minigun includes six bolt assemblies, one associated with each of the six barrels. The six bolt assemblies are attached to and surround the rotor assembly. The rotor assembly comprises the core axis of the minigun. The six barrels are attached to the forward portion of the rotor assembly and are arranged for rotation as a cluster around the core axis of the minigun. As the rotor rotates, the bolt assemblies are driven forward and rearward by a helical cam incorporated within the main housing which, in turn, causes cartridges to be delivered to the bolt assemblies, chambered, and fired. The empty cartridges are extracted from the chambers and ejected. The rotor is rotated by means of a series of gears driven by an electric motor.

An assembly illustrated in FIG. 1 and known in the prior art as the top cover and safing sector is externally attached to the main housing and forms a portion of the helical cam used to drive the bolt assemblies forward and rearward. The top cover is attached to the safing sector by means of a semi-permanent retaining pin that allows the top cover to pivot independently of the safing sector. Under normal circumstances, the top cover and safing sector are not separated and are considered a single unit. The pivot feature between the top cover and the safing sector allows the top cover to be opened and closed independently of the safing sector. The top cover and safing sector assembly is fastened to the main housing by three spring loaded pins commonly known as ball locking pins. The first one of the three ball locking pins maintains the top cover in a closed position, while the second and third ball locking pins serve to fasten the safing sector to the main housing. The second and third pins are arranged parallel to the axis of the gun, one above the other. The second, or upper, pin holds the upper portion of the safing sector, while the third, or lower, pin holds the lower portion of the safing sector.

The top cover is arranged to be opened like a hatch by removing the first pin to thereby permit access by the operator to the inner workings of the minigun. The safing sector is arranged for either partial or complete removal from the minigun. It may be partially removed by removing the first pin that retains the top cover and by also removing the second pin that holds the upper portion of the safing sector. After removing both the first and second pins, the entire top cover and the safing sector assembly may be pivoted about the third pin, away from the main housing.

The purpose of partially removing the safing sector is to dislocate the critical section of the helical cam that causes the bolt assemblies to fire the cartridges. Once the safing sector is partially removed, the minigun cannot be fired, hence the term "safing sector." Since their inception, all 7.62 mm miniguns have employed safing sectors of the same basic design.

The prior art top cover and safing sector assembly illustrated in FIG. 1 and described above is disadvantageous in its use of the first and second pins, which do not physically form part thereof. When these pins are removed, they are completely independent of the top cover and safing sector assembly. If they are attached to the minigun by means of a lanyard, the pin and lanyard combination interferes with minigun maintenance operations. If the pins are not attached to the minigun by a lanyard, they are easily lost. Both of these arrangements result in significant inconveniences, particularly in a combat environment.

It would therefore be advantageous to provide a top cover and safing sector assembly for miniguns incorporating an integral latching system that is much more convenient and reliable than the ball locking pins of the prior art described above.

In accordance with the illustrated preferred embodiment of the present invention, a spring-loaded sliding latch system is provided in the top cover. This latch system includes a sliding latch and spring contained within a latch housing of the top cover. The sliding latch is arranged to slide into an existing latch keeper within the main housing of the minigun, thereby allowing the top cover of the present invention to be readily adapted to existing miniguns. In order to open the top cover, the sliding latch is retracted, against spring pressure, until it is clear of the latch keeper, to thereby permit opening of the top cover. When the top cover is open, the operator releases the sliding latch to allow the spring to return it to its rest position against an integral stop. The top cover may later be closed by returning it to a partially closed position in which the sliding latch contacts the latch keeper, by then forcing the sliding latch to retract and move past the latch keeper by firmly pressing the top cover into its fully closed position. When the top cover is in the fully closed position, the spring forces the sliding latch to extend into the detent of the latch keeper, in turn locking the top cover in the closed position.

A spring loaded latching system is also provided in the safing sector. This latching system includes two latching pins and a single spring contained within a latch housing of the safing sector. The safing sector latching system is arranged to lock into existing keeper holes in the main housing of the minigun, thus allowing the safing sector to also be easily adapted to existing miniguns. The two latching pins are positioned end to end, sharing the same longitudinal axis. The spring is positioned between the two latching pins, in contact with the facing ends thereof, forcing the two latching pins away from each other. In the latched position, the distal ends of each of the two latching pins extend into the keeper holes in the main housing of the minigun, causing the safing sector to be fixed in relation to the main housing. Two tabs extend perpendicularly upward from the facing ends of the two latching pins to allow the operator to retract the two latching pins from the keeper holes in the main housing. Using the thumb and forefinger, the operator may unlatch the safing sector by compressing the two tabs together, against the spring pressure, until the distal ends of the two latching pins are clear of the keeper holes, following which the safing sector can be rotated away from the main housing. When the safing sector is open, the operator releases the two tabs, allowing the spring to return the two latching pins to their rest position, retained by integral stops. The safing sector may be closed by again compressing the two tabs, against the spring pressure, and then rotating the safing sector to its closed position. The safing sector is maintained in the closed position by then releasing the two tabs, thus allowing the two latching pins to move into engagement with the respective keeper holes.

DETAILED DESCRIPTION OF THE PREFERRED EMBODIMENTS

Figure 1:
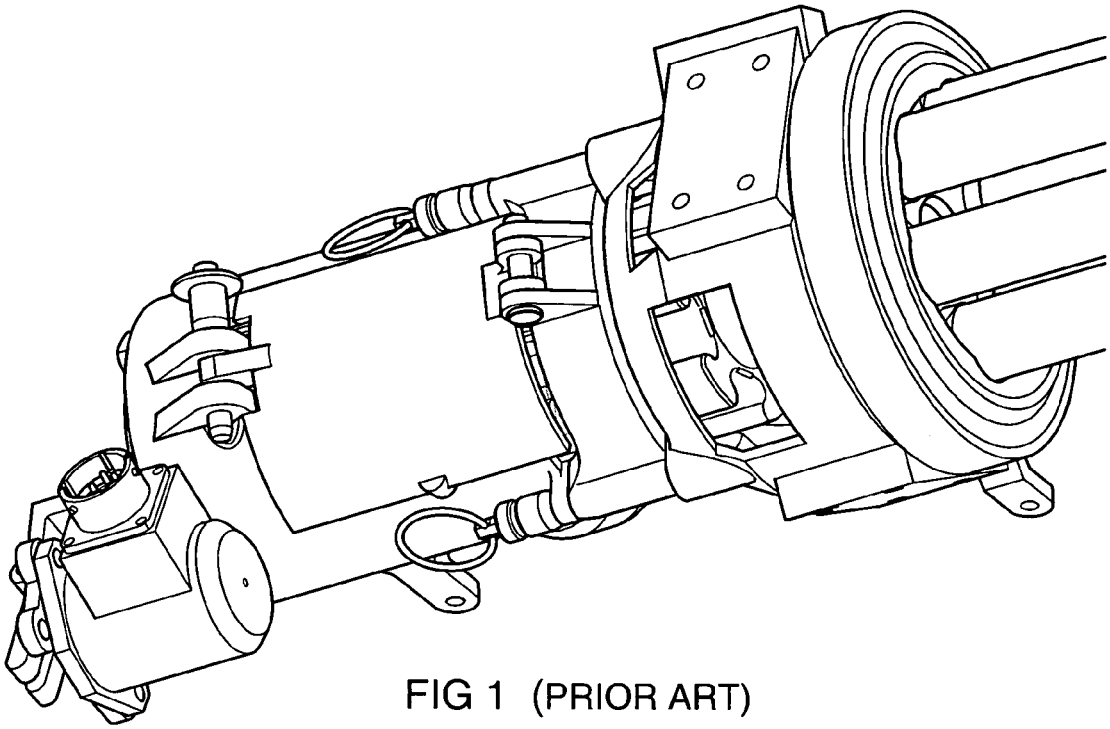
FIG 1 (PRIOR ART)
FIG. 1 is a pictorial diagram of a prior art machine gun top cover and safing sector assembly.
Figure 2:
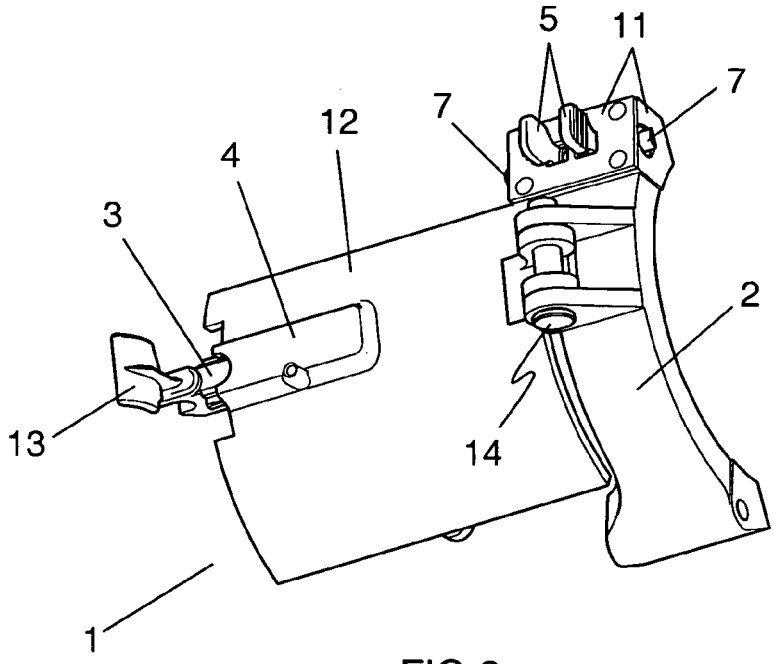
FIG. 2 is a pictorial diagram of a machine gun top cover and safing sector assembly in accordance with the present invention.
Figure 3:
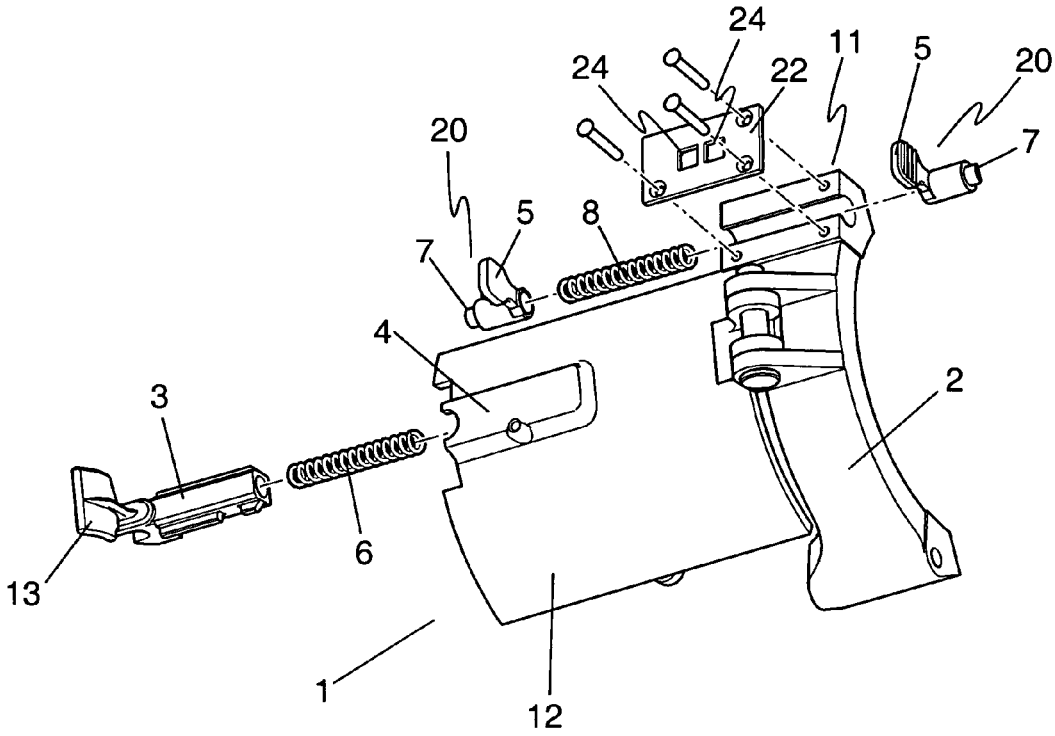
FIG. 3 is an exploded diagram of the machine gun top cover and safing sector assembly of FIG. 2.
Figure 4:
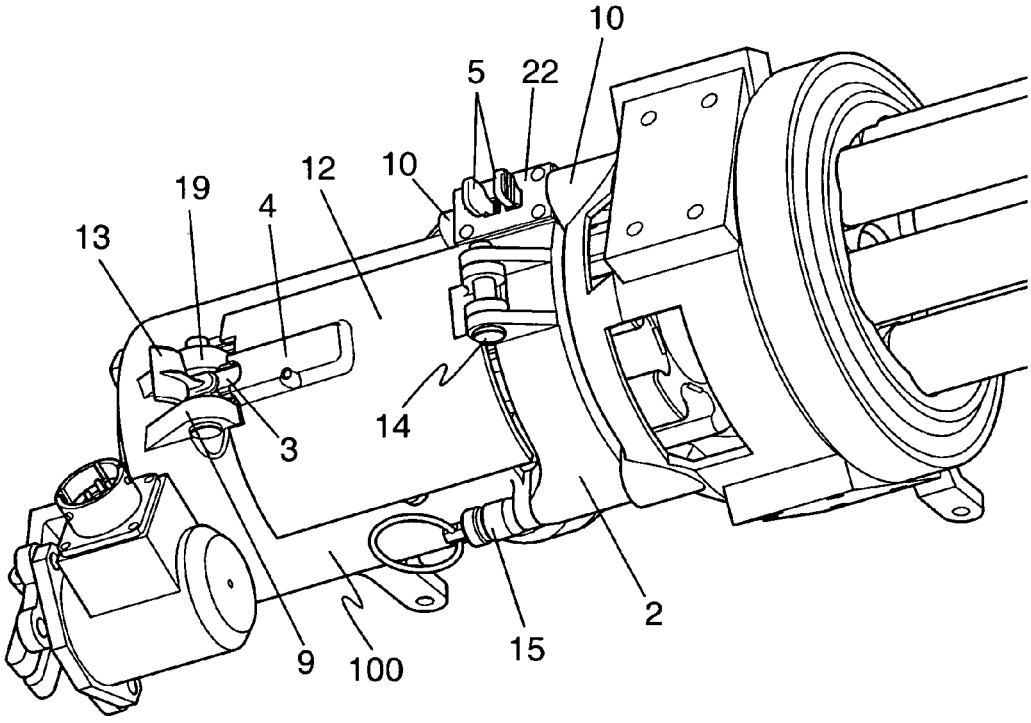
FIG. 4 pictorial diagram of the machine gun top cover and safing sector assembly of FIGS. 2 and 3, illustrating its installation on a machine gun main housing.
Figure 5:
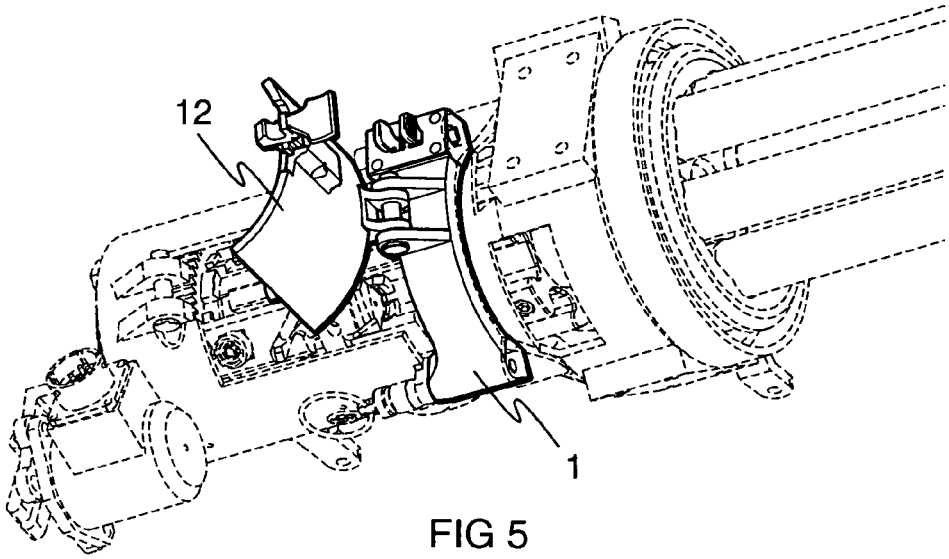
FIG. 5 is a pictorial diagram illustrating the top cover of the top cover and safing sector assembly of FIGS. 2–4 in the open position.

Referring now generally to FIGS. 2–6, there is shown a top cover and safing sector assembly 1 for attachment to a main housing 100 of a conventional 7.62 mm machine gun. The assembly 1 includes a top cover 12 hingedly attached to a safing sector 2 by means of a pin 14 that permits top cover 12 to be opened independently of safing sector 2. A pin 15 serves to hingedly attach top cover and safing sector assembly 1 to main housing 100. A latch housing 4 positioned on top cover 12 retains a sliding latch system that includes a spring-loaded sliding latch member 3 and a latch tab 13. A spring 6 within latch housing 4 serves to urge sliding latch member 3 rearward within latch housing 4. Latch tab 13, positioned at the rear end of latch member 3, is employed to manually lock latch member 3 in place over a latch keeper 9 that is conventionally provided on main housing 100 when top cover 12 is closed and to manually slide latch member 3 forward and away from latch keeper 9, against the force of spring 6, in order to open top cover 12 by rotating it upward and away from main housing 100, as illustrated in FIG. 5.

Figure 6:
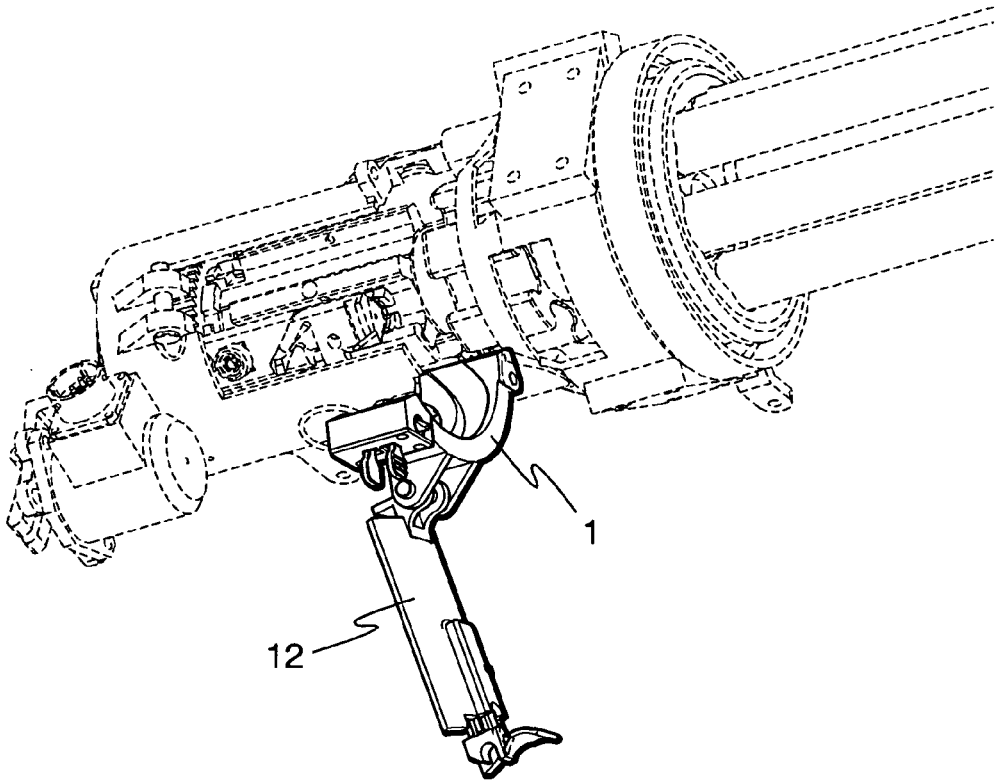
FIG. 6 is a pictorial diagram illustrating the top cover and safing sector assembly of FIGS. 2–4 in its open position.

A latch housing 11 of safing sector 2 that is positioned at the end thereof away from pin 15 serves to retain a pair of latch members 20. A latch housing top cover 24 is attached over latch housing 11 and includes a pair of openings 24 centrally positioned therein. Upwardly extending tab portions 5 of each of the latch members 20 protrude through openings 24. A spring 8 is retained between latch members 20 within latch housing 11 to urge latch members away from each other. A lower pin portion 7 that is perpendicular to the tab portion 5 of each of the latch members 20 protrudes outwardly therefrom so as to engage a respective one of a pair of safing sector keeper openings 10 that are conventionally provided in main housing 100 when safing sector 2 is closed. Safing sector 2 may be readily opened, after opening top cover 12, by simply manually compressing the tab portions 5 of latch members 20 toward each other, against the force of spring 8, to thereby disengage the pin portions.7 thereof from the safing sector keeper openings 10, thus allowing the entire top cover and safing sector assembly 1 to be rotated about pin 15, outward and away from main housing 100, as illustrated in FIG. 6. The top cover and safing sector assembly may be just as easily closed and locked into that position by reversing this procedure.

I claim:

1. A machine gun of the having a main housing and a top cover and safing sector assembly hingedly attached to the main housing external thereto, said main housing having a top cover latch keeper and a safing sector latch keeper fixedly provided thereon, said top cover and safing sector assembly comprising:

a safing sector hingedly attached to said main housing;

a top cover hingedly attached to said safing sector; and a top cover latch assembly for permitting said top cover to be moved between open and closed positions, said top cover latch assembly comprising a top cover latch housing mounted on said top cover proximate said top cover latch keeper, said top cover latch housing retaining a spring-loaded sliding latch member therein, said sliding latch member having a latch tab mounted at a rearward end thereof, said latch tab being manually actuable for releasable engagement with said top cover latch keeper to permit movement of said top cover between said open and closed positions thereof.

2. A machine gun of the having a main housing and a top cover and safing sector assembly hingedly attached to the main housing external thereto, said main housing having a top cover latch keeper and a safing sector latch keeper fixedly provided thereon, said top cover and safing sector assembly comprising:

a safing sector hingedly attached to said main housing;

a top cover hingedly attached to said safing sector;

a top cover latch assembly for permitting said top cover to be moved between open and closed positions; and a safing sector latch assembly for permitting said top cover and safing sector assembly to be moved between open and closed positions, said safing sector latch assembly comprising a safing sector latch housing mounted on said safing sector proximate said safing sector latch keeper, said safing sector latch housing having a central channel therein and having a top cover with a pair of tab openings centrally positioned therein, said safing sector latch assembly further comprising a pair of safing sector latch members, each of said safing sector latch members having a tab portion that extends upwardly through a respective one of said tab openings in said top cover and a lower pin portion that protrudes outwardly within said central channel for engagement with said safing sector latch keeper when said top cover and safing sector assembly is in said closed position thereof.

3. A machine gun as in claim 2, wherein said safing sector latch assembly further comprises a spring member positioned within said channel between said safing sector latch members for urging said safing sector latch members away from each other, said safing sector latch members being manually actuable, by compressing said tab portions thereof, for enabling engagement of said pin portions thereof with said safing sector latch keeper when moving said top cover and safing sector assembly to its closed position and for enabling disengagement of said pin portions thereof from said safing sector latch keeper when moving said top cover and safing sector assembly to its open position.

* * * * *